US010436207B2

(12) United States Patent
Hustvedt et al.

(10) Patent No.: US 10,436,207 B2
(45) Date of Patent: Oct. 8, 2019

(54) AUTOMATIC FAN INLET CLOSURE APPARATUS AND METHODS

(71) Applicant: Acoustiflo, Ltd., Boulder, CO (US)

(72) Inventors: David Hustvedt, Boulder, CO (US); Jerry Mills, Boulder, CO (US)

(73) Assignee: Acoustiflo, Ltd., Boulder, CO (US)

( * ) Notice: Subject to any disclaimer, the term of this patent is extended or adjusted under 35 U.S.C. 154(b) by 467 days.

(21) Appl. No.: 15/190,013

(22) Filed: Jun. 22, 2016

(65) Prior Publication Data

US 2017/0030363 A1 Feb. 2, 2017

Related U.S. Application Data

(60) Provisional application No. 62/282,149, filed on Jul. 28, 2015.

(51) Int. Cl.

| | |
|---|---|
| ***F04D 25/14*** | (2006.01) |
| ***F04D 29/28*** | (2006.01) |
| ***F04D 29/42*** | (2006.01) |
| ***F04D 27/00*** | (2006.01) |

(52) U.S. Cl.

CPC ..... *F04D 25/14* (2013.01); *F04D 27/003* (2013.01); *F04D 29/281* (2013.01); *F04D 29/4226* (2013.01)

(58) Field of Classification Search

CPC ..... F04D 25/14; F04D 27/003; F04D 29/48; F04D 29/287

See application file for complete search history.

(56) References Cited

U.S. PATENT DOCUMENTS

| | | | | |
|---|---|---|---|---|
| 2,373,166 A | | 4/1945 | Chapman et al. | |
| 2,430,225 A | | 11/1947 | Hagler | |
| 2,459,815 A | | 1/1949 | Hammell | |
| 3,401,624 A | * | 9/1968 | Mohrman ..... | F24F 7/025 454/344 |
| 4,244,685 A | | 1/1981 | Lahtinen | |

(Continued)

OTHER PUBLICATIONS

U.S. Appl. No. 62/282,149, filed Jul. 28, 2015. First Named Inventor: David Hustvedt.

(Continued)

*Primary Examiner* — Igor Kershteyn
*Assistant Examiner* — Juan G Flores
(74) *Attorney, Agent, or Firm* — Santangelo Law Offices, P.C.

(57) ABSTRACT

Embodiments of the inventive technology may include an automatically reconfigurable flow blocking damper to prevent back flow; applications include, e.g., centrifugal fans that may at times be susceptible to such back flow, such as centrifugal fans established in an array and discharging to a common space. A clutch may effect damper engagement with rotatable componentry such that the damper is engaged with rotatable componentry when the damper is in open configuration, and effect damper disengagement from rotatable componentry such that the damper is disengaged from rotatable componentry when the damper is in closed configuration. The clutch may, in particular embodiments, act to prevent rotational imbalance problems otherwise observed when the damper is engaged to and rotates with rotatable componentry.

32 Claims, 12 Drawing Sheets

(56) References Cited

U.S. PATENT DOCUMENTS

| | | | |
|---|---|---|---|
| 4,429,856 | A | 2/1984 | Jackson |
| 4,482,291 | A | 11/1984 | Chakrawarti et al. |
| 4,808,068 | A | 2/1989 | Asbjornson |
| 5,922,095 | A | 7/1999 | Hustvedt et al. |
| 6,375,719 | B1 | 4/2002 | Hustvedt et al. |
| 7,001,140 | B2 | 2/2006 | Hustvedt et al. |
| 7,357,621 | B2 | 4/2008 | Hustvedt et al. |
| 7,963,749 | B1 | 6/2011 | Mecozzi |

OTHER PUBLICATIONS

U.S. Appl. No. 14/245,947, filed Apr. 4, 2014. First Named Inventor: David Hustvedt.

* cited by examiner

AUTOMATIC FAN INLET CLOSURE APPARATUS AND METHODS

This US Non-Provisional patent application claims priority to, and the benefit of, U.S. Provisional Application No. 62/282,149, filed Jul. 28, 2015, said provisional application incorporated herein by reference in its entirety.

TECHNICAL FIELD

The present disclosure is directed to apparatus and methods for preventing back flow through centrifugal fans.

BACKGROUND

Air delivery systems for building ventilation may consist of several centrifugal fans operating in parallel, perhaps in an array (e.g., a bank or assembly) in order to act together to provide more airflow than one alone could provide to a common area, space or shared discharge plenum. At times, a fan in that array becomes inoperative due to mechanical failure, electrical supply issues, or planned system functions (as but a few examples) while other fans in that array continue to operate. When one of the fans is not operating (i.e., is inoperative), it may be important to prevent the reverse flow of air (backflow) through the inoperative fan. Backflow may occur when the pressure downstream of the fans acts to force air back through (in a reverse direction) the inoperative fan(s). This is, of course, undesired, as it may reduce pressure downstream of the fan (e.g., such that it is less than an intended, design pressure), among possibly having other negative impacts. Embodiments of the inventive technology may help to resolve such negative impact(s) by obstructing such backflow through an inoperative fan of a fan array while allowing (and not unacceptably impacting) "forward" flow when that fan is operating, in addition to having other applications. Note that the inventive technology may even have application to a centrifugal fan that is not in an array, but that may be susceptible to undesired backflow when that fan is inoperative if its flowpath is not obstructed at that time.

The inoperative fan backflow problem has been known for some time and there are conventional approaches to its solution. But the use of conventional dampers, for example, placed at the inlet to the fans has the disadvantage of reducing fan performance during normal operation and increasing the noise of the fan due to flow disturbances created by the damper. Certain conventional approaches may also be either mechanically complex (e.g., by requiring centrifugally actuated linkages and springs to, e.g., move a damper from one configuration to another) or require external attachment at the fan inlet (or external actuating assemblies), both of which can reduce fan performance, lead to imbalance problems during fan rotation, and/or increase noise. Embodiments of the inventive technology seek to alleviate one or more of these problems.

SUMMARY OF ASPECTS OF THE INVENTIVE TECHNOLOGY

Embodiments of the inventive technology include apparatus that eliminate back flow through an inoperative centrifugal fan without complex mechanical linkages, external supports at the fan inlet, or actuators. In addition, particular embodiments do not reduce fan performance and may reduce fan noise by reducing turbulence in the fan inlet. In embodiments of the inventive shut-off apparatus, a closure damper is automatically "opened" by air flow through the fan at the start of normal operation and stays open during such operation. When the fan is stopped and there is a commencement of reverse flow through the fan, or a tendency towards such reverse flow (e.g., related to failed or declining airflow into the fan inlet), due to a pressure differential, the damper moves towards the "closed" configuration and settles in that configuration, remaining there while the pressure differential across the fan produced by other fans operating in parallel, exists. In the closed configuration, the damper may be held in place against the fan inlet by this pressure differential. Particular embodiments of the inventive technology include a clutch that causes the damper to be engaged with rotatable componentry at certain times (such as when the damper is in open configuration) so that the damper rotates with that rotatable componentry when the damper is in open configuration, and that causes the damper to be disengaged from rotatable componentry at certain other times (e.g., when the damper is in closed configuration) so that the damper does not rotate with that rotatable componentry when the damper is in closed configuration. In this way, the clutch may be said to couple the damper with rotatable componentry in open configuration and decouple the damper from rotatable componentry in closed configuration. In certain embodiments, the closure damper can be held in approximately the same angular location (relative to the fan wheel or other rotatable componentry) when the damper is in open configuration. This particular feature may minimize or eliminate rotational imbalance of the inventive fan otherwise caused by a varying rotational position of the damper. Additional aspects of the inventive technology relate to methods, including a related centrifugal fan method and a method of manufacturing an inventive fan. Yet other aspects relate to an inventive retrofit kit and related retrofit method.

BRIEF DESCRIPTION OF THE DRAWINGS

The accompanying drawings, which are included to provide a further understanding of the present disclosure, are incorporated in and constitute a part of this specification, illustrate aspects of the present disclosure and together with the detail description serve to explain the principles of the present disclosure. No attempt is made to show structural details of the present disclosure in more detail than may be necessary for a fundamental understanding of the present disclosure and the various ways in which it may be practiced. In the drawings.

BRIEF DESCRIPTION OF THE INVENTIVE TECHNOLOGY

Figure 1:
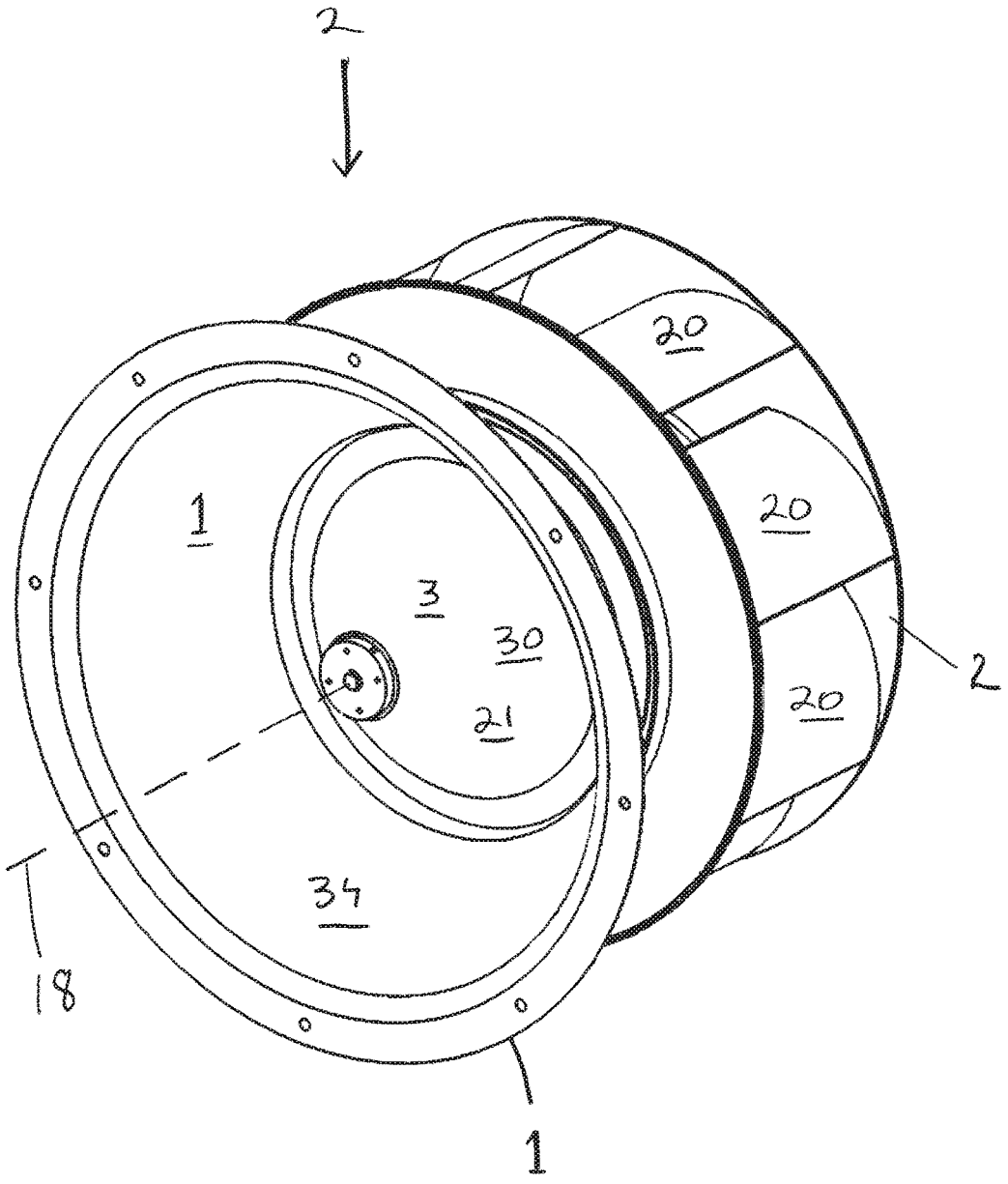
FIG. 1 shows a perspective view of an inventive closure damper apparatus installed in an exemplary centrifugal fan and in closed configuration. Of course, a fan that includes or features the inventive closure apparatus is inventive also. Note that FIG. 1, along with FIGS. 2-4, and 7 and 8, do not show a fan housing, in order to more clearly show certain fan componentry/features.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application. The aspects of the present disclosure and the various features and the advantageous details thereof are explained more fully with reference to the non-limiting aspects and examples that are described and illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the present disclosure. The examples used herein are intended merely to facilitate an understanding of ways in which the present disclosure may be practiced and to further enable those of skill in the art to practice the aspects of the present disclosure. Accordingly, the examples and aspects herein should not be construed as limiting the scope of the present disclosure, which is defined solely by the appended claims and applicable law. Moreover, it is noted that like reference numerals represent similar parts throughout the drawings.

At least one embodiment of the inventive technology may be described as a centrifugal fan 2 comprising stationary fan inlet componentry 1 that defines an opening 16 through which fluid (e.g., air, any gaseous fluid, liquid, etc.) enters said centrifugal fan; rotatable componentry 17 established downstream of the stationary fan inlet componentry, wherein said rotatable componentry rotates about a fan axis 18 in response to an applied torque (e.g., a motor applied torque), said rotatable componentry comprising blades 20 that impel said fluid (e.g., air, gas generally, possibly liquid); an axially translatable flowpath closure damper 21 that axially translates along said fan axis (whether along a central shaft 5 or otherwise) and that is reconfigurable from a closed configuration 23 to an (fully) open configuration 22; a damper support 24 that supports said axially translatable flowpath closure damper so that it can axially translate 36 along said fan axis; and a clutch 50 that engages said axially translatable flowpath closure damper to said rotatable componentry so that, when said axially translatable flowpath closure damper is in said (fully) open configuration, said axially translatable flowpath closure damper co-rotates with said rotatable componentry.

Note that the clutch (which, by itself is an aspect of the inventive technology), may engage the damper to rotatable componentry so that the two co-rotate when the damper is in open configuration regardless of when the actual process of engagement occurs (it does not need to occur only when the damper is in (fully) open configuration); similarly, the clutch may disengage the damper from rotatable componentry so that the two do not co-rotate when the damper is in closed configuration regardless of when the actual process of disengagement occurs (it need not occur when the damper is in its closed (meaning fully closed) configuration. The process of engagement and/or disengagement may occur when the damper is in an intermediate, partially closed, partially open configuration, or instead even when the damper is in its fully open configuration (as may typically be seen with stud and slot clutch designs). Engagement/disengagement in the biased ball and shaft groove clutch design would take place depending on the location of the fan back plate distal end of the groove. Note that open configuration as used herein (and in the claims) implies fully open configuration. The apparatus may, as may many if not all centrifugal fans, include a fan housing, which may surround the fan wheel (which includes, e.g., fan blades and annular supports therefor) and direct impelled air out of the fan through an outlet defined and created by the fan housing.

Rotatable componentry is any one or more, including all, of the several components that are rotated in response to the applied torque, and that always (in all apparatus configurations) co-rotates with the same speed (RPM) as the rotating fan blades (a broad term that includes any fan components that act to impel fluid via, e.g., impact therewith). Where, e.g., four different parts always co-rotate with the same speed as the rotating fan blades, each of such parts is referred to as rotating componentry, as are two, three or all four of such parts. Fan blades 20 are always rotatable componentry; in most designs, any annular supports between which such blades may be sandwiched are also rotatable componentry. And in many embodiments where the fan includes a central shaft 5, and such shaft always co-rotates with the blades, such shaft is rotatable componentry. Similarly, any fan back plate 26 may be rotatable componentry, as may be any componentry substantially against that back plate (whether directly against it, or separated from it due to intervening componentry).

The component of the inventive technology that reconfigures from a closed configuration (where it prevents fluid flow by blocking a flowpath of that fluid) to an open configuration (i.e., fully open, where it does not obstruct fluid flow in any meaningful or operationally impairing way), may be referred to as a flowpath closure damper, or simply a damper. It may be an axially translatable flowpath closure damper 21, translating along the fan axis of rotation, whether that axis coincides with a central shaft or not. Reconfiguration may be achieved via a pressure differential. For example, a pressure on the fan back plate proximal surface 29 of the damper (damper surface closer to the fan back plate) that is higher than the pressure on the fan back plate distal surface 30 of the damper (surface that is further from the ban blades than is the other damper surface), as may be seen in a single fan in a bank of fans when that fan shuts down but others in that bank continue to operate, may cause reconfiguration from open to closed configuration (and may keep the damper in that closed configuration), and a higher pressure on the fan back plate distal surface of the damper of a single fan (as may be seen when a fan is operating (e.g., being driven by a motor to impel fluid)) may cause reconfiguration to open configuration (and may keep the damper in that open configuration). Accordingly, the reconfiguration force may be fluid (e.g., air) pressure (or perhaps more precisely, a fluid (e.g., air) pressure differential), and the system may, in that regard, be air flow driven. The reliance on differential air pressure to achieve damper reconfiguration, and the related absence, in preferred embodiments of the inventive technology, of any bias such as spring bias, that acts on the damper, may help to simplify the inventive technology. Indeed, certain embodiments of the inventive technology may operate without spring bias on the damper in any orientation, including when the axis of rotation is horizontal or has other orientation.

Figure 2:
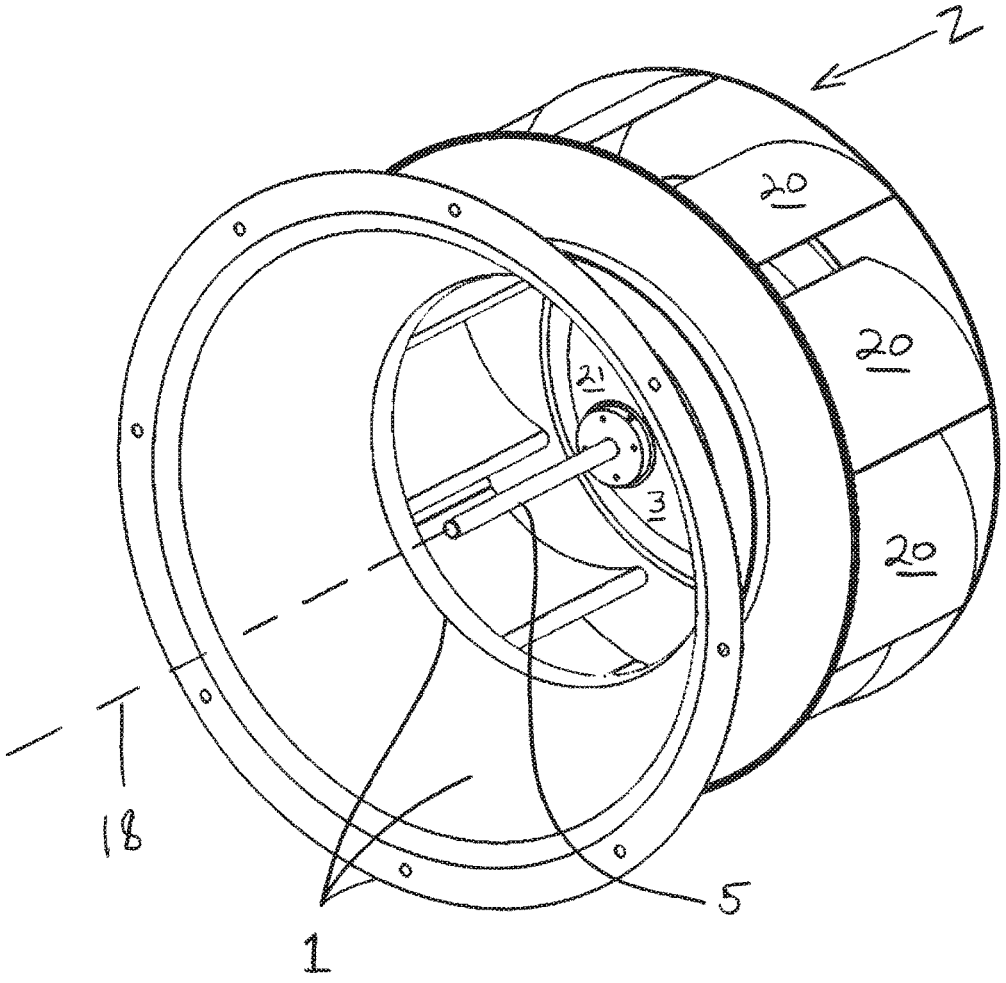
FIG. 2 shows a perspective view of the apparatus of FIG. 1 installed in an exemplary centrifugal fan and in an open configuration.
Figure 3:
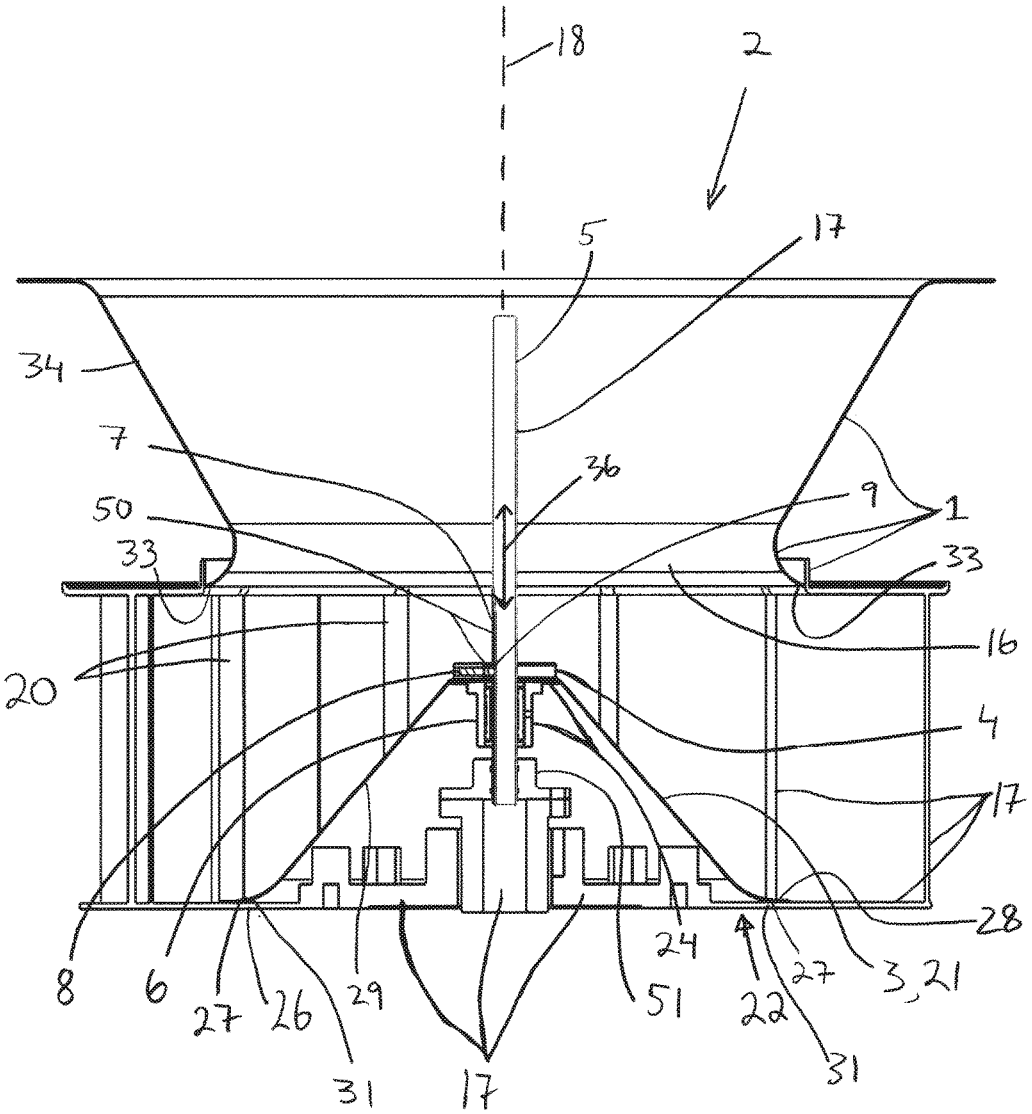
FIG. 3 shows a sectional view (in a plane that includes the fan axis) of a fan featuring the inventive flowpath closure apparatus of FIG. 2 (open configuration).
Figure 4:
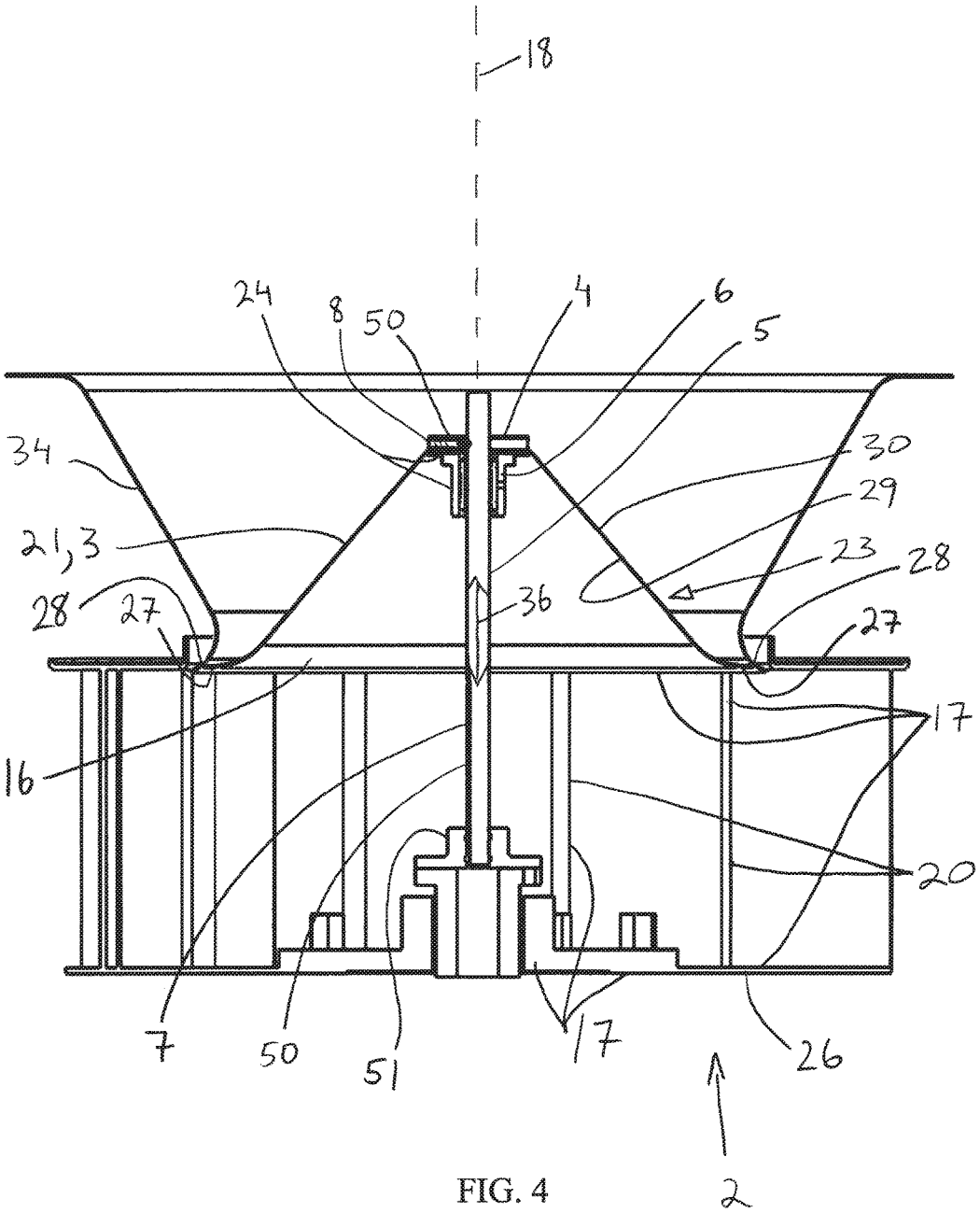
FIG. 4 shows a sectional view of a fan featuring the inventive closure apparatus of FIG. 1 (closed configuration).
Figure 9A:
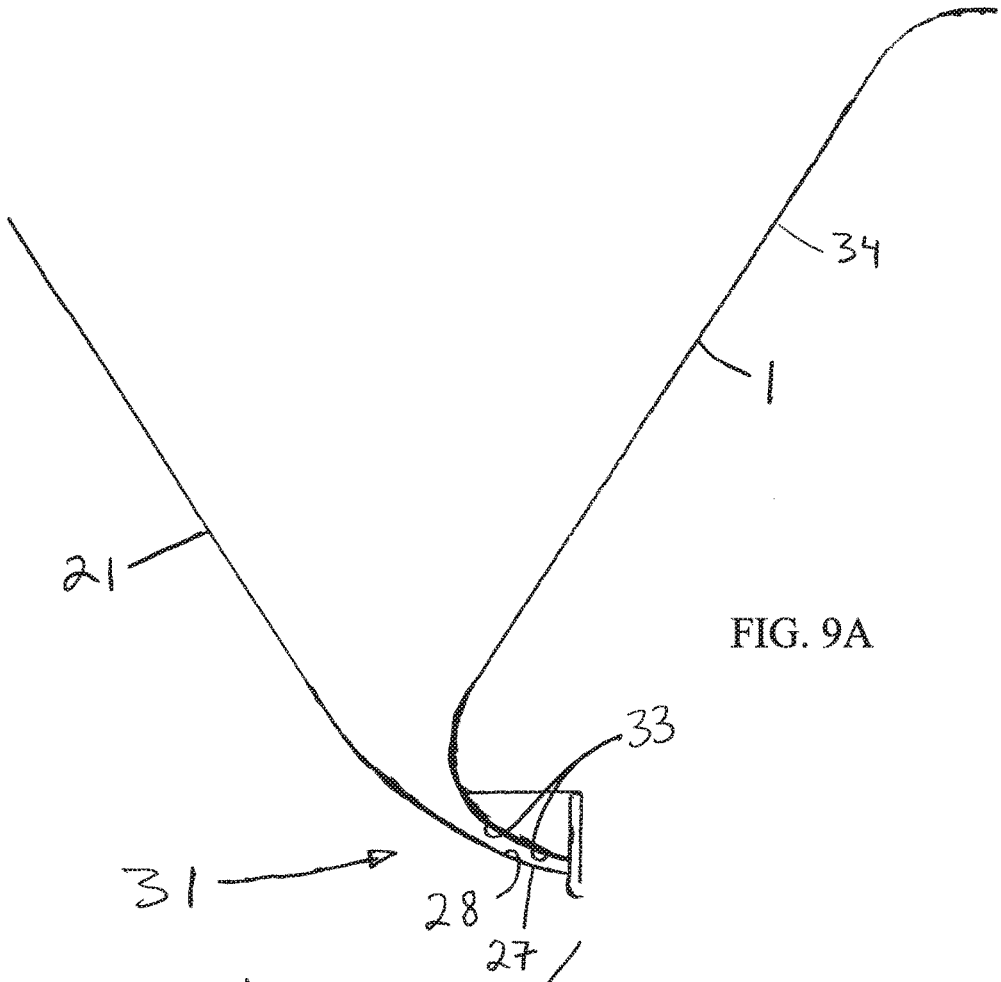
FIG. 9A shows a sectional view (in a plane that includes the fan axis) of the damper and inlet componentry when the damper is near closed configuration.
Figure 9B:
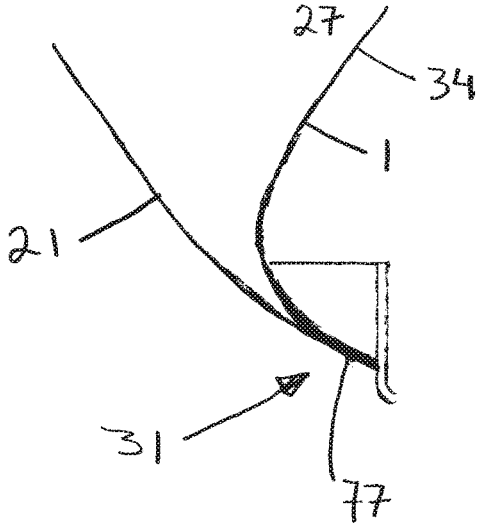
FIG. 9B shows a sectional view (in a plane that includes the fan axis) of the damper and inlet componentry when the damper is in closed configuration.

FIG. 1 shows an exemplary centrifugal fan 2 and its associated stationary inlet componentry 1, in addition to an embodiment of an automatic inlet closure damper 3 (which in many embodiments is no different from an axially translatable flowpath closure damper 21). The stationary fan inlet componentry may be that componentry that directs fluid from upstream of the centrifugal fan into the fan along a flowpath. The damper may of any of several shapes, including but not limited to a disc shape as shown in the figures. The damper can be sealed against (e.g., held tightly enough against componentry so as to prevent flow (meaning to block flow, or, in other words, to close flow) in at least one direction) stationary inlet componentry (e.g., a fan back plate distal surface 28 of a bottom portion 31 of the damper 21 can seal against an annular, fan blade proximal surface portion 31 of a fan inlet cone) to prevent back flow of fluid (e.g., air) through the fan when the fan is inoperative (i.e., not spinning to impel fluid through the fan in a forward direction), as shown in FIGS. 1 and 4, and FIG. 9B. During normal fan operation the damper is in a (fully) open configuration as shown in FIGS. 2 and 3, with the damper held against the back plate of the fan by dynamic air pressure. More detail of an embodiment is shown in the sectional view of FIG. 3 showing the damper in the (fully) open configuration. The damper 3, 21 may be axisymmetric as shown (but need not be, necessarily), and in certain embodiments conical shape (shown), and formed from preferably thin metal.

In FIG. 3's embodiment, the bottom portion of the damper 31 (e.g., the fan back plate proximal portion, or the portion of that damper having the largest diameter, and that is closest to the bottom of the page in FIGS. 3 and 4) may have a fan back plate proximal surface 27 (i.e., surface of the bottom of the damper of FIG. 3 that is closer to the fan back plate) that is configured so that it can rest securely against the back plate 26 of the fan 2 when the damper is in the (fully) open configuration. The fan back plate distal surface 28 of the bottom portion 31 of the damper may be shaped to seal against inlet componentry 1 when the damper is in the closed configuration 23. Such intentional size and shape of the damper to achieve the indicated functionality is not limited merely to the dampers shown in the figures. In some embodiments, a gasket of suitable material may be attached to either one or both sides of portions of the damper that contacts the fan to create a seal or in response to dynamic pressure during fan operation. Accordingly, there may be gasket material at the fan back plate proximal surface 27 of the bottom portion 31 of the damper (that contacts rotatable componentry when the damper is in the open configuration), e.g., to reduce noise, and/or there may be gasket material on the fan back plate distal surface 28 of the bottom portion 31 of the damper (that is in contact with stationary inlet componentry when the damper is in the closed configuration), e.g., to enhance sealing.

When the damper is in a closed configuration, it may seal against, e.g., stationary fan inlet componentry 1 (which includes, but is not limited to, sealing against merely one component of all stationary inlet componentry, where such rotatable componentry, as is typical, includes more than one component). Such seal may be against an annular, fan blade proximal surface portion 33 of, e.g., a fan inlet cone 34, as but one example (or, more generally, fan inlet componentry), to obstruct the flowpath. The damper 3, 21 may have any of several shapes, including but not limited to disc-shaped, conical, frustoconical, pyramidal, cylinder-end shap, hemispherical, etc., including curved (in a cross-section in a plane that includes the axis of rotation) so as to help to guide flow more smoothly onto the fan blades. Particularly where the fan includes a central shaft 5 (whether such shaft is rotatable componentry 17 or not), the damper 3, 21 may have a central hole 35 through which that shaft may extend (where axial translation 36 of the damper 3, 21 from open configuration to closed configuration, and back to open configuration, and repeatedly back and forth as may be seen depending on magnitudes of pressures on the two sides of the damper, may occur via, e.g., sliding of the damper relative to the shaft). The damper support 24 may include a bearing 6 that allows for axial translation 36 (e.g., sliding) along the shaft. Where the central shaft 5 is rotatable componentry, the clutch 50 may engage the damper to that shaft such that the damper co-rotates with the shaft when the damper is in the open configuration.

Also shown in FIG. 3 is a damper support that may support the inlet closure damper 3, 21 so that it can axially translate (e.g., along a central shaft). The damper support 24 may include a damper bearing (6) that allows the damper (3) to axially translate (via, e.g., sliding); such bearing also allows rotation of the damper relative to the central shaft when co-rotation of such components is not desired, and where the clutch has disengaged the damper from the rotatable componentry. The damper support may be rigidly attached to the damper, such that whenever the damper rotates, so does the damper support Embodiments of the inventive technology may include a clutch 50 that acts to engage the damper to rotatable componentry so that, when the damper (or fan generally) is in the open configuration, the damper co-rotates with that componentry (and with the fan blades). The clutch may act to cause the fanwheel to be coupled to the damper (so that they co-rotate), perhaps only at certain times (e.g., when the damper is in the open configuration). The clutch may act to cause the damper to be engaged to rotatable componentry when the damper is in the open configuration (which is seen where, when the damper is in such configuration, the damper is somehow engaged to the rotatable componentry, regardless of when such engagement actually occurs).

That clutch 50 also may act to disengage the damper from that rotatable componentry so that, when the damper in in closed configuration, the damper does not co-rotate with the rotatable componentry (which is seen even where the actual process of disengagement occurs before the damper is in the closed configuration). Accordingly, when the damper is engaged with rotatable componentry, the damper co-rotates with that rotatable component (and there is no relative motion between the damper and rotatable componentry); when it is disengaged from rotatable componentry, there is relative rotation between the damper and rotatable componentry. Disengagement when the damper is in closed configuration may be desired because otherwise, there may be unacceptable relative motion at a seal interface 77 of the damper to stationary inlet componentry caused by rotation of the fanwheel, which may be caused by backflow pressure. Such relative motion could have undesired effect, including increasing noise and/or the risk of fire. Engagement and disengagement may occur automatically, as where, e.g., no human action is required. Such automatic operation may occur as a result of axial translation of the damper (in response to a change in relative pressure on the two sides of the damper), and of the clutch design. As explained, where one fan of an array 81 of operating fans suddenly fails or shuts down for other reason, pressure on the discharge side of that bank may act to translate the damper from open configuration to closed configuration. Of course, each centrifugal fan of the array may preferably include the reconfigurable, flow blocking damper.

Examples of clutches that achieve automatic engagement and/or automatic disengagement include: (a) entrapped, spring biased ball 9, groove 7 along fan back plate proximal portion 37 of central shaft, bias (e.g., spring 8) and clutch housing 4 (even if only part of the clutch is enclosed in such housing, it is still a clutch housing); (b) stud 12 and slot 13; (c) stud 12 and arm 14; and (d) fan back plate proximal surface 27 of bottom portion 31 of the axially translatable flowpath closure damper 21 and rubber surfacing at either said fan back plate proximal surface portion 27 (of the "bottom" portion of the damper) and/or a fan back plate 26. Note that wherever any sort of surface treatment is used, whether it be rubber, gasket or otherwise, such is considered to be the surface of the component or component portion to which it is applied. At least part of the clutch may be secured (in any fashion, including but not limited to compression fitting) to the damper, the damper support, or rotatable componentry. Particularly in the entrapped, biased ball, and central shaft groove clutch embodiments, part of the clutch may be within the damper support. In embodiments, when the damper is in closed configuration, part of the clutch may rotate with rotatable componentry and part may remain stationary with the damper.

Figure 5:
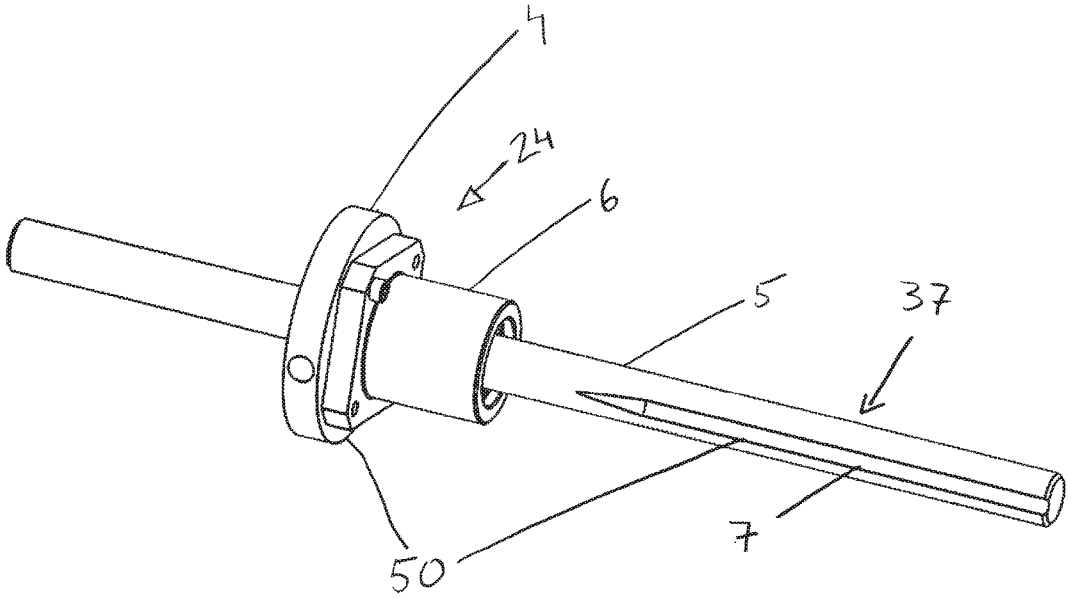
FIG. 5 shows a perspective view of an exemplary clutch assembly.

A clutch may operate to engage the damper to rotatable componentry 1 of the fan (in the case of, e.g., FIG. 5, the fan's central shaft (5)) so that the two co-rotate when desired (and perhaps do not co-rotate when such co-rotation is not desired, such as when the damper is in closed configuration). Such shaft may be attached to bolts on the hub 51 of the fan. The clutch 50 may cause the damper to rotate with the rotatable componentry (e.g., co-rotate with the shaft), e.g., when the damper is in open configuration, and also possibly not co-rotate with the rotatable componentry when, e.g., the damper is in closed configuration). Indeed, in certain embodiments, relative rotation between or among the damper and rotatable componentry (e.g., as seen where the rotatable componentry rotates and the damper does not) may be important when the damper is in closed configuration, and absence of relative rotation may be important when the damper (such that the damper and rotatable componentry rotate together) is in open configuration. Where relative rotation does occur, it may be allowed or facilitated by a damper support bearing 6. Allowing such relative rotation when the damper is in the closed position prevents abrasion and wear of the damper against stationary fan inlet componentry 1 (see FIG. 4, which shows the damper in the closed configuration). The clutch assembly may also allow the fan to freely rotate relative to the damper when the damper is in the closed position (so that fan rotation when the damper is closed (perhaps caused by back pressure of other fans that are operating) does not cause rotation of the damper relative to the stationary inlet componentry against which it would typically seal).

Figure 6:
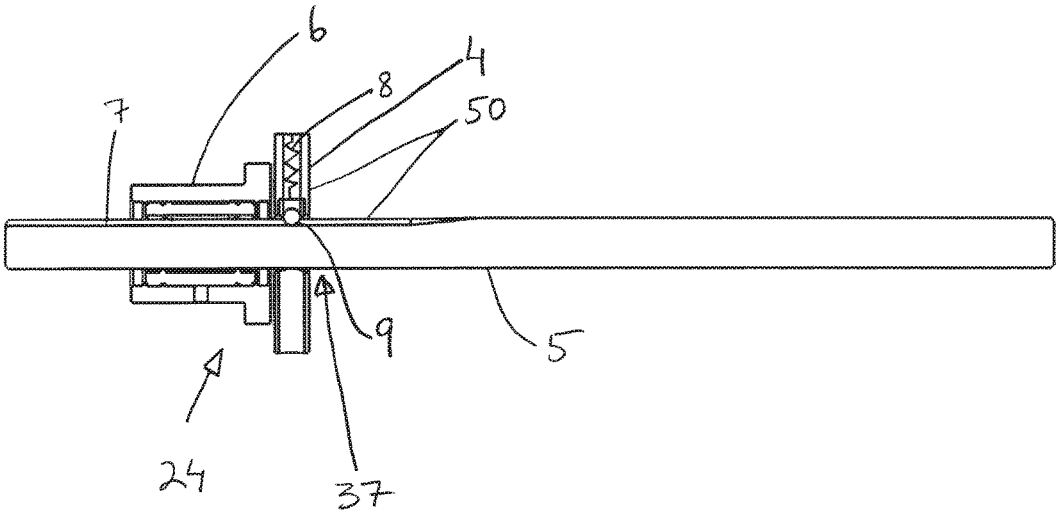
FIG. 6 shows a cross sectional view of the clutch assembly of FIG. 5.

The clutch of FIGS. 3 and 4 is shown in FIG. 5 without the damper, for clarity. A damper support 24 having a suitably dimensioned bearing 6 that allows linear and rotational motion relative to a shaft 5 of a certain dimension may be used to support the damper 3, 21 so that it can axially translate along the fan axis of rotation 18. Such bearing 6 may also allow rotation of the rotatable componentry 17 relative to the damper where the clutch enables this. The shaft in this embodiment has a groove 7 machined into it along a fan back plate proximal portion 37 of its length; such groove is considered part of the clutch in such embodiment, as are the spring 8 and biased, entrapped ball 9. FIG. 6 shows a sectional view of one embodiment of the clutch. The clutch housing 4 contains in one embodiment a spring 8 and an entrapped ball 9 (that is biased towards the bar, and its groove) that will be contained within the machined groove 7 (or instead continually roll over the shaft where there is no groove for the biased ball to land in, depending on the axial position of the damper on the shaft). Note that this single groove device not only enables co-rotation of the damper with the rotatable componentry, but it also assures that the damper engages the rotatable componentry (here the central shaft) at the same angular location 40 (of the damper relative to the rotatable componentry, in a plane that is orthogonal to the axis of rotation; see FIG. 10) every engagement, thereby preventing imbalance problems in applications where such would otherwise be observed. The angular location(s) at which engagement of the damper to rotatable componentry is limited are chosen (during design, or perhaps on site, after a damper is attached, perhaps using a trial and error approach and a clutch housing or clutch components whose angular location may be adjusted on the damper, perhaps by a customer even) not to result in imbalance issues. This clutch embodiment achieves this "fixed" angular location engagement feature by including only one groove in the central shaft, and an entrapped, biased ball along only one radius (out from the fan axis of rotation).

Figure 7:
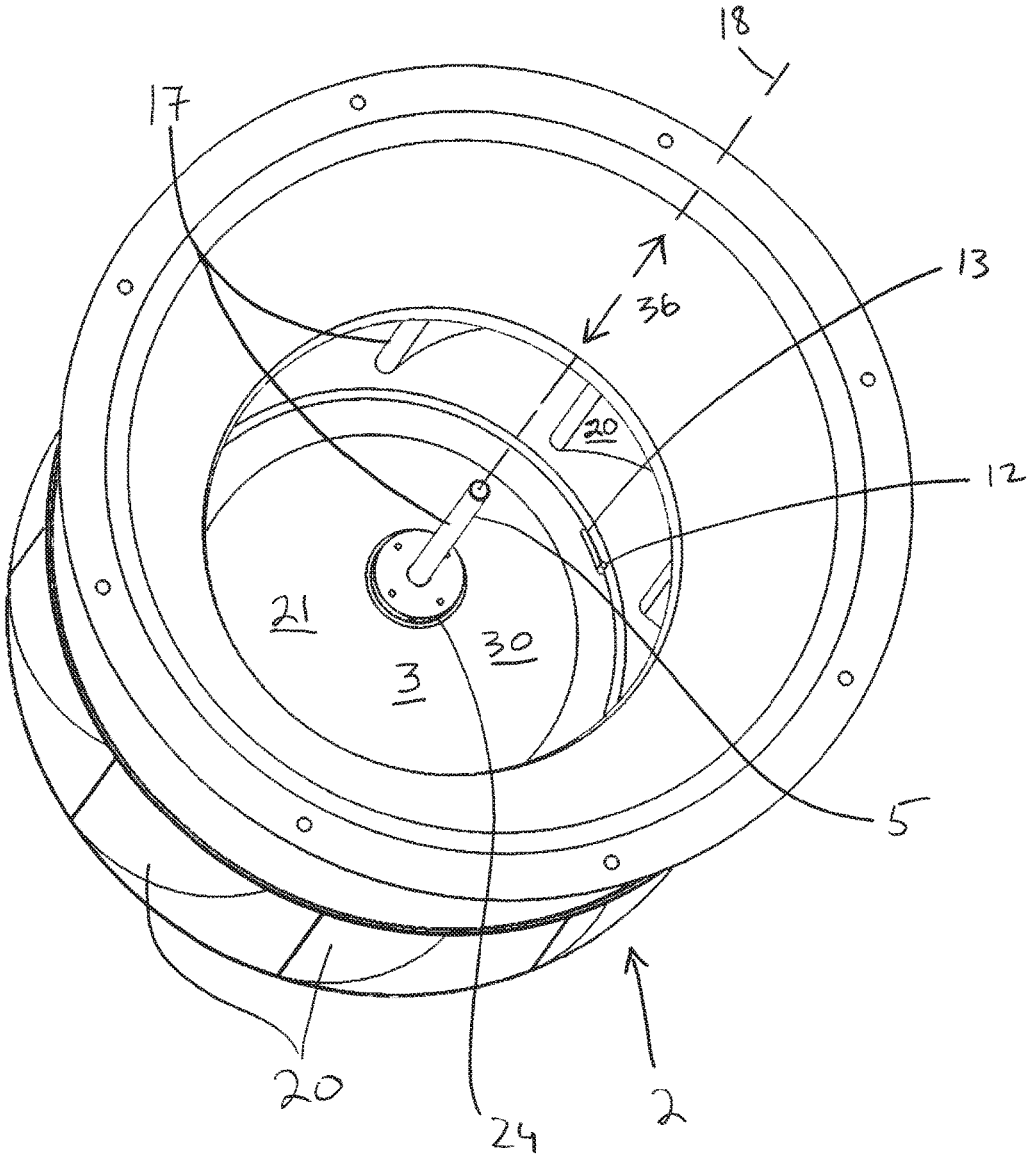
FIG. 7 shows another embodiment of a clutch that can fix the relative angular position of an open damper so that it settles in the same position relative to rotatable componentry every time it closes.
Figure 8:
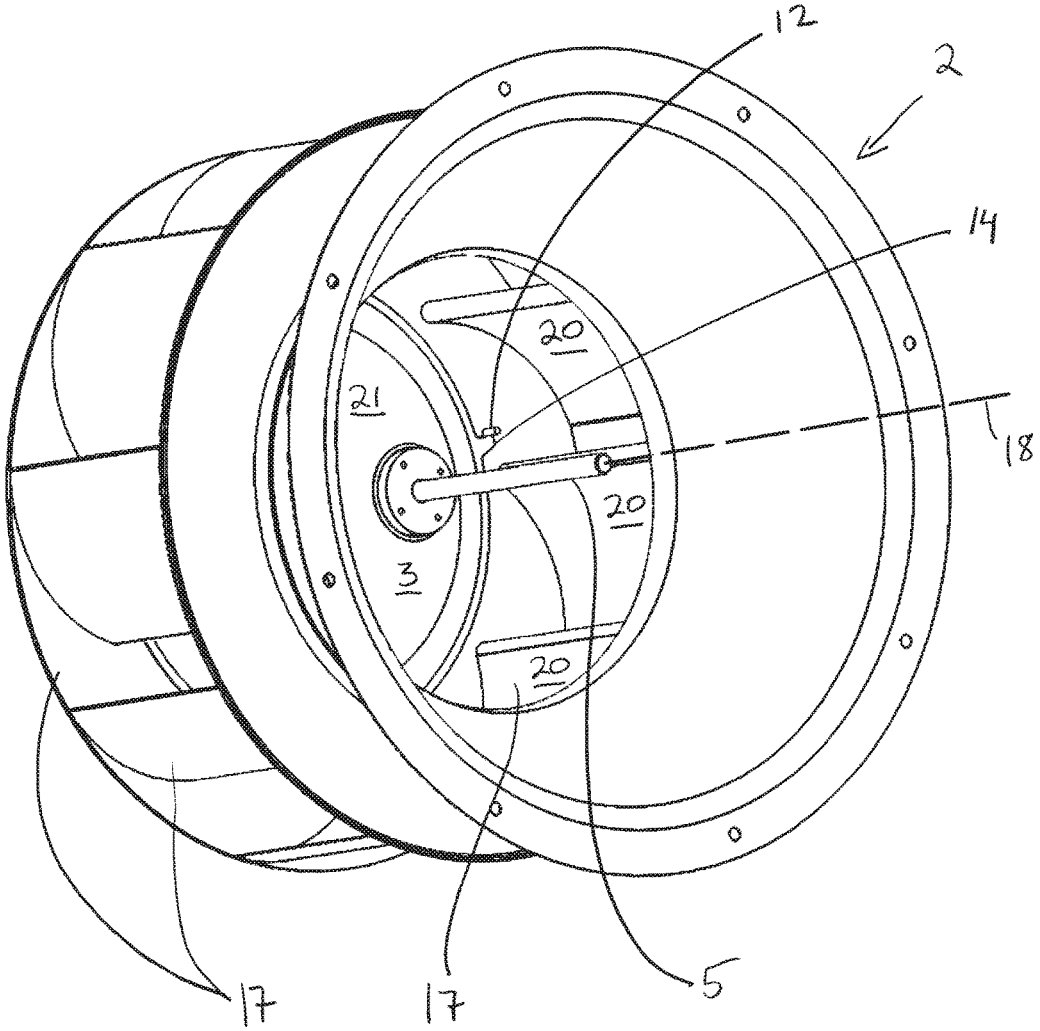
FIG. 8 shows another implementation of a clutch (and the fan on which it is featured).

Additional embodiments of clutches include, e.g., as shown in FIG. 7, a stud 12 extending axially from the backplane of the fan engages a slot 13 in the damper 3 as the disk approaches the open position. FIG. 8 shows another clutch embodiment; it includes a stud 12 on the back plate that engages an arm 14 extending from the damper 3, 21. In the implementation of FIG. 8, the arm 14 could be flexibly restrained to absorb the impact energy of the disk 3 as it comes to rest on the fan wheel 2. Generally, such embodiments of the clutch may include latch components.

Note that in certain embodiments, the clutch may engage the damper to rotatable componentry at only those angular location(s) (of the damper relative to rotatable componentry) that do not result in unacceptable imbalance problems during rotation. Note that even in axisymmetric dampers, imbalance related problems may manifest during damper rotation. Essentially, a damper may affect overall fan balance during rotation due to, generally, the rotating center of gravity being slightly off the rotational axis of the fan. In more structural terms, this eccentricity may be caused by, e.g., small variations in damper thickness or slight eccentricity of the damper relative to a fan central shaft. Certain angular locations may exhibit, e.g., greater eccentricity than other angular locations, and thus may cause unacceptable imbalance where other angular locations do not. Note that balance (or imbalance) of a rotating fanwheel (and damper), may be determined via measurement of the speed of the rotating fan relative to fan supports (said motion occurring due to the rotating center of gravity being slightly off the rotational axis of the fan); an average fan specification may be an imbalance of 0.2 inches/sec while a lower tolerance specification may be, e.g., 0.1 inches/sec.

Figure 10:
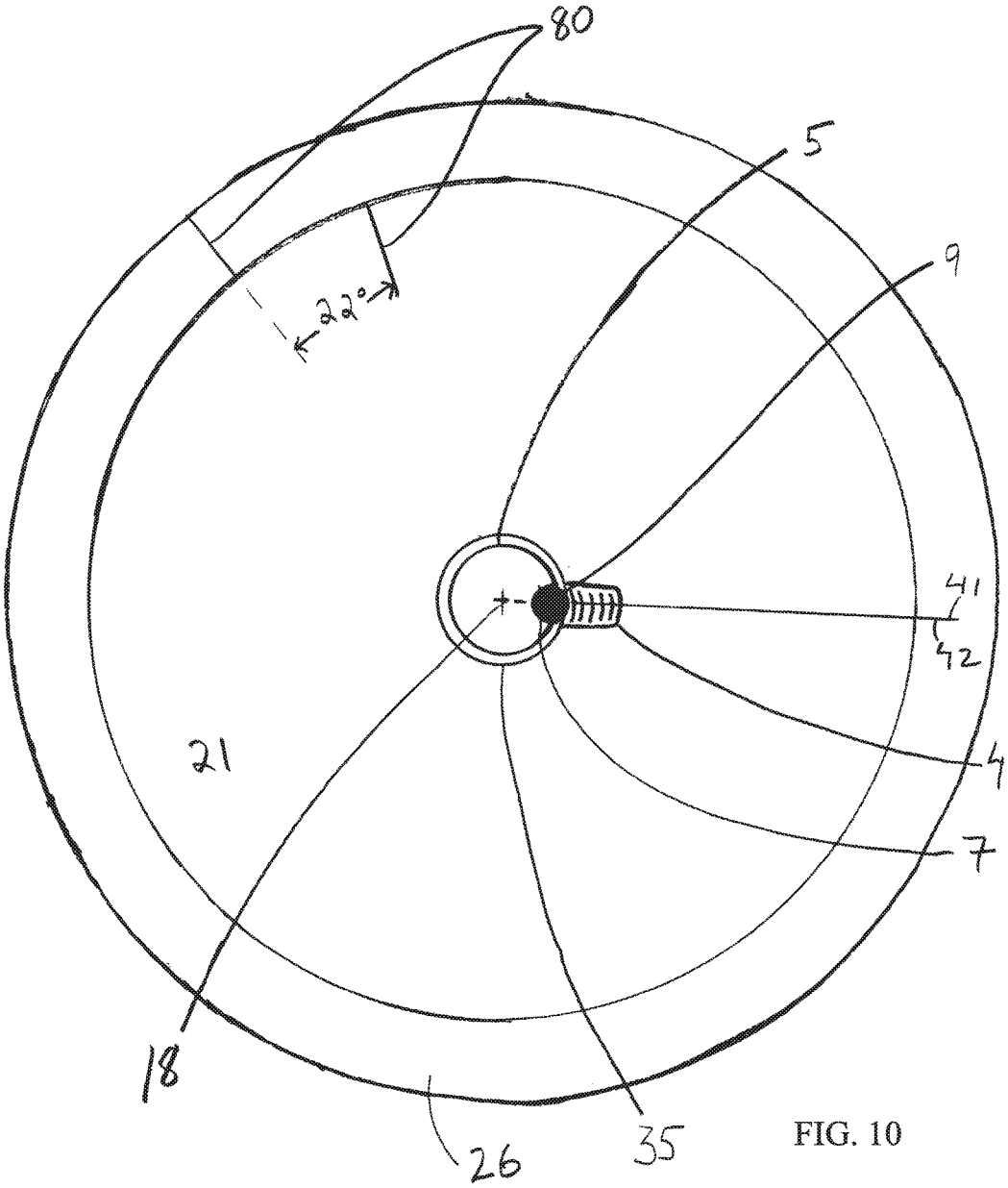
FIG. 10 shows a sectional view (in a plane orthogonal to the fan axis), and looking into a fan, of a damper in relation to rotatable componentry (in particular, rotatable componentry in this figures includes the central shaft and the fan back plate). It shows two different sets of radii that can be used to identify two different degree measurements for the same relative angular location of the damper.
Figure 11:
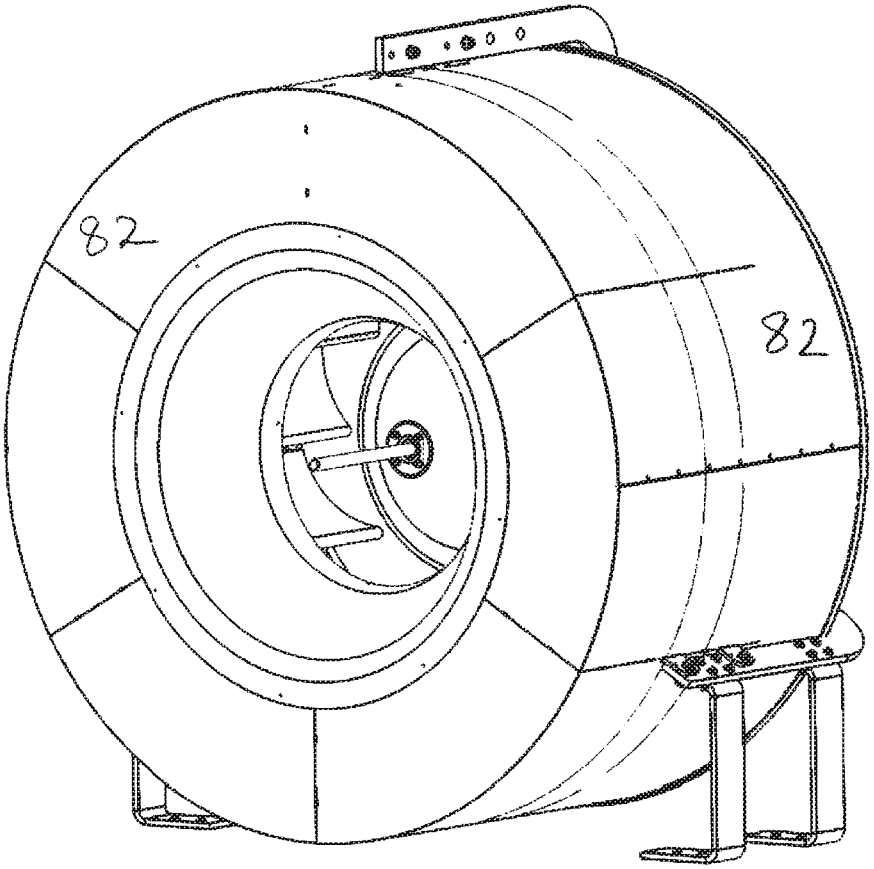
FIG. 11 shows a centrifugal fan with a housing with damper in open configuration.
Figure 12:
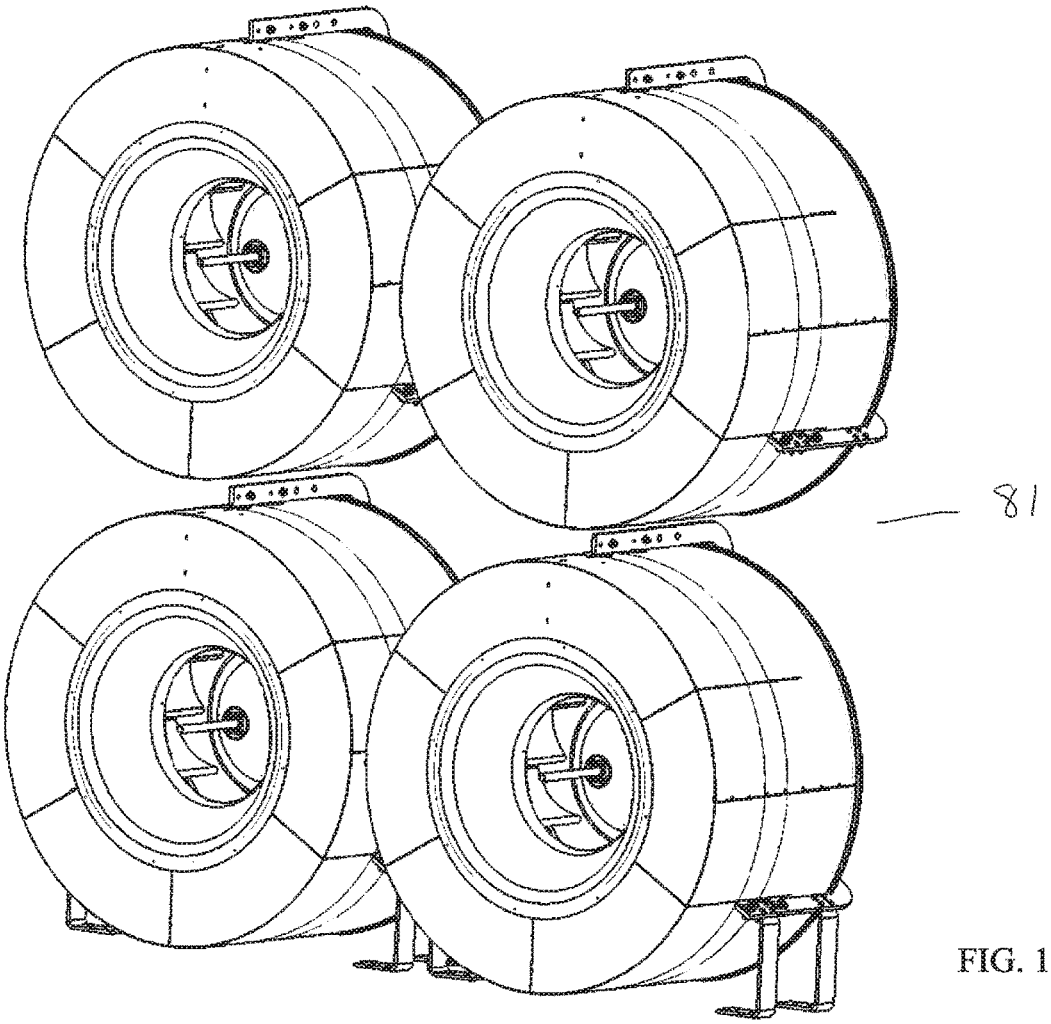
FIG. 12 show a centrifugal fan with a housing in an array of centrifugal fans with housings. All fans have dampers in open configuration.

As should be understood, in order to specify a relative angular location 40 (in a plane that is orthogonal to the axis of rotation) of the damper relative to rotatable componentry, it may be helpful, at least conceptually, to specify or indicate a radius on the damper 41 and a radius on the rotatable componentry 42, thereby allowing for determination of an angle therebetween (thus indicating a relative angular location). Such radii 41, 42 could be demarcated by certain components on the damper (including clutch components attached to the damper), and on the rotatable componentry. Such radii would originate at the fan axis and travel in a plane that is orthogonal to that axis. In certain apparatus having a ball and groove clutch design, the housing of the single entrapped ball may help to demarcate a radius on the damper that it rotates with, and the groove on the rotatable componentry may help to demarcate a radius on the central shaft (and the angular location between such radii in such case would be 0 degrees, as shown in FIG. 10, because such radii overlap one another). However, permanent markings 80 on the damper and the rotatable componentry could also indicate the angular location at which the damper settles relative to the rotatable componentry in the achieving its closed position. FIG. 10 also shows such relative angular location using such markings (see the 22 degree indication thereon).

An absence of imbalance related problems may be seen in low damper mass, low damper mass to rotational componentry mass ratio, and/or highly axisymmetric (about a damper axis of rotation) dampers. To avoid imbalance problems, engagement may be at the same angular location during each and every engagement (where such location does not result in imbalance problems), or instead, engagement may always at one of a limited number (e.g., only a few) angular locations at each and every engagement (where each of such angular locations do not result in imbalance problems during co-rotation of the damper with the rotatable componentry). This limitation on angular locations during engagement may be achieved by the clutch itself. For example, in embodiments where the clutch includes a single groove along (usually only part of) the fan back plate proximal portion 37 of the central shaft of a fan, and a ball or balls along a single radius of the clutch (and a spring(s) that biases that ball(s) towards the shaft, and a clutch housing), the fact that there is only one groove (straight along a portion of the shaft), and ball(s) along only one radius, allows an engagement of the damper to the shaft in only one angular location (of the damper relative to the shaft), and during every engagement (which occurs when the entrapped ball is within the axial extent of the groove), the damper engages in that same (relative) angular location. Where that angular location is selected because it does not result in imbalance issues during rotation, restricting engagement in such fashion helps to avoid producing an imbalance when the fan wheel rotates, and the damper, in the open configuration, co-rotates therewith.

In applications where engagement in two or more angular locations does not lead to any observed, unacceptable imbalance-related impacts on fan operation when the damper is in open configuration, the clutch may allow engagement in any one (or any two or more) of such two or more angular locations. For example, a clutch following the general design of FIG. 5 (and FIGS. 3 and 4) may allow only two possible relative angular locations during engagement of the damper to the rotatable componentry where the clutch includes two grooves (along two radii of the central shaft), and an entrapped ball along only one radius. To achieve such engagement location restrictions, in embodiments with a stud and arm, there may be only one (or a few) stud and one (or a few) arm; in embodiments with a stud and slot, there may be only one (or a few) stud and one (or a few) slot, in embodiments with a latch (which includes two corresponding components that can latch onto each other when one is forced towards the other), there may be only one (or a few) latch. By selecting the correct number (and location) of grooves, latches, slots, studs, arms, etc., the damper can be made to "settle" into or land in only those relative angular positions that do not cause unacceptable imbalance problems during rotation (for example, one stud and two slots would allow two different possible (relative) angular locations of the damper during engagement). Achieving such limited engagement would be a relatively straightforward matter of selecting the proper number of clutch components (e.g., shaft grooves, entrapped ball(s), slots, arms, studs, latches, etc.) and their proper location (perhaps after experimentally determining which (relative) angular locations do not result in unacceptable imbalance issues).

Note that certain clutch designs (e.g., where the clutch is only a fan back plate proximal surface 27 of the bottom portion 31 of the axially translatable flowpath closure damper and rubber surface on either (or both) the fan back plate proximal surface portion 27 (of the bottom damper portion) 31 or a fan back plate), the damper may engage rotatable componentry (e.g., the back plate of the fan) in any of perhaps innumerable different angular positions. However, in certain applications, this may result in at least some engagements that are unacceptably out of balance (and possibly some that are in balance). Such a clutch would typically be unacceptable for such applications (because it does not fix damper angular location in open configuration as is necessary). However, in certain other applications, such a clutch may be acceptable because, regardless of where engagement occurs in an unrestricted engagement location design (i.e., the angular location of the damper relative to the rotatable componentry), there may be no unacceptable imbalance issues. Note also that many systems allow for some degree of observable/measurable imbalance-type effects (e.g., anything less than 0.2 inches/sec of the rotating fan relative to its supports), and thus a clutch that provides for re-engagement only in the same (or in one of a few) relative, pre-determined angular location(s) is not always necessary. Indeed, in applications where every single angular location (in a system that does not fix angular location) results in a sufficiently balanced rotation (such that there are no imbalance issues during engagement and rotation, regardless of where the damper lands relative to the rotatable componentry), then there may be no need for the clutch to limit angular locations of the damper relative to rotatable componentry during engagement in any manner whatsoever.

As will be apparent to one skilled in the art, the angles, sizes and shapes of the component parts may be adjusted to meet requirements of specific fans without departing from the spirit and scope of the present disclosure. For example, the contours and shape of the damper 3, 21 may be adjusted to accommodate the design details of a particular fan or to optimize the air flow past the disk. The diameter of the shaft 5 or the details of the clutch groove 7 may also be adjusted as necessary. The design of the damper support 24 may be modified to include a variety of materials and components. In addition, the latch type clutch incorporated in the back plate of the fan and the damper (as shown in FIGS. 7 and 8) that would fix the position of the disk 3 relative to the fan 2 could be implemented in a variety of methods obvious to one skilled in the art. Further, and as relates more to the general application of the inventive technology, it is of note that the inventive apparatus (and methods), may apply more to not only a fan, but also a pump (e.g., centrifugal pump) (which, as with a CF fan, is a type of (centrifugal) prime mover, which can be generally described as a device that imparts energy to a fluid). A characteristic feature of applications of preferred embodiments of the inventive technology may be that the inlet diameter (e.g., diameter at the inlet side of the fanwheel, at the fan back plate side of an inlet cone) is less than the blade diameter (or fanwheel diameter); such may allow "entrapment" or hiding of the damper against the smaller inlet.

Embodiments of the inventive technology may also be described as a centrifugal fan method comprising the steps of: defining, with fan inlet componentry 1, an inlet opening 16 through which fluid enters a centrifugal fan; rotating rotatable componentry of the centrifugal fan 2 about a fan axis of rotation 18, with a motor; impelling the fluid with blades 20 of the rotatable componentry; engaging an axially translatable flowpath closure damper 21 to the rotatable componentry so that when the axially translatable flowpath closure damper is in an open configuration 22, the axially translatable flowpath closure damper is engaged to the rotatable componentry; co-rotating the axially translatable flowpath closure damper with the rotatable componentry when the axially translatable flowpath closure damper is in the open configuration; axially translating the axially translatable flowpath closure damper along the fan axis from the open configuration to a closed configuration 23; and obstructing the inlet opening 16 with the axially translatable flowpath closure damper when the axially translatable flowpath closure damper is in the closed configuration. The claims as filed, which are incorporated herein as part of this disclosure, provide additional detail about particular embodiments of the inventive method technology disclosed in this application.

Particular embodiments of the inventive technology may relate more directly to a method of manufacturing a centrifugal fan. Certain embodiments of such inventive technology may be describe as a centrifugal fan manufacturing method comprising the steps of: establishing stationary fan inlet componentry 1 to define an opening 16 through which fluid enters the centrifugal fan 2; establishing rotatable componentry 17 substantially within a fan housing 82 (which is seen, e.g., where the fanwheel is inside of the housing), downstream of the stationary fan inlet componentry, and to rotate about a fan axis 18 in response to an applied torque, the rotatable componentry comprising blades 20 that impel the fluid; establishing an axially translatable flowpath closure damper to axially translate along the fan axis and to be reconfigurable from a closed configuration 23 to an open configuration 22; establishing a damper support 24 to support the axially translatable flowpath closure damper so that it can axially translate along the fan axis; and establishing a clutch 50 to engage the axially translatable flowpath closure damper to the rotatable componentry when the axially translatable flowpath closure damper is in the open configuration 22 so the axially translatable flowpath closure damper is engaged to and co-rotates with the rotatable componentry when the axially translatable flowpath closure damper is in the open configuration. Steps of establishing specified componentry may be accomplished generally by connecting, securing, or placing specified componentry in relation to other componentry to achieve the specified goal (e.g., "to define an opening"; "to rotate about a fan axis"; "to axially translate along a fan axis", etc.) or to meet other indicated limitations or features. The claims as filed, which are incorporated herein as part of this disclosure, provide additional detail about particular embodiments of the inventive method technology disclosed in this application.

Note that certain embodiments of the inventive technology may be described as a retrofit kit for a centrifugal fan 2 that comprises an axis of rotation 18 about which rotatable componentry rotates in response to an applied torque, and stationary fan inlet componentry 1 that defines an opening 16 through which fluid enters the centrifugal fan. The retrofit kit may comprise a flowpath closure damper 21 configured so that, when installed as part of the fan, the flowpath closure damper is axially translatable along the axis of rotation of the fan so that the flowpath closure damper is reconfigurable from a closed configuration to an open configuration; a damper support 24 that supports the axially translatable flowpath closure damper so that it can axially translate along the fan axis; and a clutch 50 configured so that, when installed as part of the fan, the clutch engages the flowpath closure damper to the rotatable componentry when the flowpath closure damper is in the open configuration so that, when the flowpath closure damper is in the open configuration, the flowpath closure damper is engaged to and co-rotates with the rotatable componentry. Purchasers of this kit may use its contents to alter (retrofit) an existing centrifugal fan to include certain features that enable the fan (upon installation of kit contents) to achieve advantages of the inventive technology including but not limited to, prevention of backflow through a non-operative fan of a fan bank.

The inventive technology includes a method for retrofitting a centrifugal fan 2 that comprises an axis of rotation 18 about which rotatable componentry 17 rotates in response to an applied torque, and stationary fan inlet componentry 1 that defines an opening 16 through which fluid enters the centrifugal fan. This method may comprise the steps of: installing a flowpath closure damper 21 onto and as part of the centrifugal fan so that, after the installation, the flowpath closure damper is axially translatable along the axis of rotation of the fan so that the flowpath closure damper is reconfigurable from a closed configuration 23 to an open configuration 22; installing a damper support 16 to support the axially translatable flowpath closure damper 21 so that it can axially translate along the fan axis; and installing a clutch 50 onto and as part of the centrifugal fan so that, after the installation, the clutch engages the flowpath closure damper to the rotatable componentry when the flowpath closure damper is in the open configuration so that, when the flowpath closure damper is in the open configuration, the flowpath closure damper is engaged to and co-rotates with the rotatable componentry. These steps, along with others specified in the claims filed with the initial application, could be performed, e.g., after purchase of the retrofit kit.

Note that particular embodiments of the inventive technology, whether retrofit or otherwise, may feature one or more of the following: axial transition of the flowpath closure damper is not caused by rotation or stoppage of rotation (i.e., it may be independent of rotation); axial rotation of the damper is not dependent on any sort of threaded engagement; axial translation of the damper does not rely on centrifugal/centripetal force; axial translation of the damper is attributable solely to fluid (e.g., air) pressure differential; axial translation of the damper is independent of bias (e.g., spring) operation; axial translation of damper is independent of any telescoping shaft or telescoping generally; axial translation of damper independent of any linkages, cams of force multipliers; general application in the field of air handling or air delivery systems, perhaps for heating, ventilation and air conditioning.

As can be easily understood from the foregoing, the basic concepts of the present invention may be embodied in a variety of ways. It involves both flow blockage techniques as well as devices to accomplish the appropriate flow blockage. In this application, the blockage techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "closure" should be understood to encompass disclosure of the act of "closing"—whether explicitly discussed or not—and, conversely, were there effectively disclosure of the act of "closing", such a disclosure should be understood to encompass disclosure of a "closure" and even a "means for closing." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the damper/automatic closure devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A centrifugal fan method comprising the steps of:

defining, with stationary fan inlet componentry, an inlet opening through which fluid enters a centrifugal fan;

rotating rotatable componentry of said centrifugal fan about a fan axis of rotation, with an applied torque generated by a motor, said rotatable componentry established downstream of said stationary fan inlet componentry;

impelling said fluid with blades of said rotatable componentry;

engaging, with a clutch that comprises a stud and arm, an axially translatable flowpath closure damper to said rotatable componentry so that when said axially translatable flowpath closure damper is in an open configuration, said axially translatable flowpath closure damper is engaged to said rotatable componentry;

co-rotating said axially translatable flowpath closure damper with said rotatable componentry when said axially translatable flowpath closure damper is in said open configuration;

supporting, with a damper support, said axially translatable flowpath closure damper, so that it can axially translate along said fan axis;

axially translating said axially translatable flowpath closure damper along said fan axis from said open configuration to a closed configuration; and obstructing said inlet opening with said axially translatable flowpath closure damper when said axially translatable flowpath closure damper is in said closed configuration.

2. A centrifugal fan method as described in claim 1 further comprising the step of disengaging said axially translatable flowpath closure damper from said rotatable componentry so that when said axially translatable flowpath closure damper is in said closed configuration, said rotatable componentry can rotate without said axially translatable flowpath closure damper co-rotating therewith.

3. A centrifugal fan method as described in claim 2 further comprising the step of rotating said rotatable componentry without rotating said axially translatable flowpath closure damper when said axially translatable flowpath closure damper is in said closed position.

4. A centrifugal fan method as described in claim 2 wherein said step of disengaging said axially translatable flowpath closure damper from said rotatable componentry takes place during performance of said step of axially translating.

5. A centrifugal fan method as described in claim 1 wherein said step of obstructing said inlet opening with said axially translatable flowpath closure damper comprises the step of sealing said axially translatable flowpath closure damper against said stationary fan inlet componentry.

6. A centrifugal fan method as described in claim 1 further comprising the step of securing at least part of said clutch to said axially translatable flowpath closure damper.

7. A centrifugal fan method as described in claim 1 wherein said step of engaging, with a clutch that comprises a stud and arm, an axially translatable flowpath closure damper to said rotatable componentry comprises the step of engaging an axially translatable flowpath closure damper to componentry selected from the group consisting of: central shaft of fan; back plate of fan; componentry against a back plate of said fan, at least one fan blade; and annular support for fan blades.

8. A centrifugal fan method as described in claim 1 wherein said step of axially translating said axially translatable flowpath closure damper along said fan axis comprises the step of axially translating an axially translatable flowpath closure damper along a central shaft of said rotatable componentry of said fan.

9. A centrifugal fan method as described in claim 8 wherein said axially translatable flowpath closure damper has a central hole through which said central shaft of said rotatable componentry of said fan extends.

10. A centrifugal fan method as described in claim 1 wherein said step of engaging, with a clutch that comprises a stud and arm, an axially translatable flowpath closure damper to said rotatable componentry comprises the step of engaging an axially translatable flowpath closure damper with a clutch that comprises a fan back plate proximal surface of a bottom portion of said axially translatable flowpath closure damper and rubber surface on either said fan back plate proximal surface or a fan back plate.

11. A centrifugal fan method as described in claim 1 wherein said step of engaging, with a clutch that comprises a stud and arm, an axially translatable flowpath closure damper to said rotatable componentry comprises the step of engaging said axially translatable flowpath closure damper to said rotatable componentry at any of a limited number of angular locations during each engagement.

12. A centrifugal fan method as described in claim 11 wherein said step of engaging, with a clutch that comprises a stud and arm, an axially translatable flowpath closure damper to said rotatable componentry comprises the step of engaging said axially translatable flowpath closure damper to said rotatable componentry at the same angular location during each engagement.

13. A centrifugal fan method as described in claim 1 wherein said centrifugal fan is a fan of a fan array.

14. A centrifugal fan comprising:

stationary fan inlet componentry that defines an opening through which fluid enters said centrifugal fan;

rotatable componentry established downstream of said stationary fan inlet componentry, wherein said rotatable componentry rotates about a fan axis in response to an applied torque, said rotatable componentry comprising blades that impel said fluid;

an axially translatable flowpath closure damper that axially translates along said fan axis and that is reconfigurable from a closed configuration to an open configuration;

a damper support that supports said axially translatable flowpath closure damper so that it can axially translate along said fan axis; and a clutch that engages said axially translatable flowpath closure damper to said rotatable componentry so that, when said axially translatable flowpath closure damper is in said open configuration, said axially translatable flowpath closure damper is engaged to and co-rotates with said rotatable componentry, wherein said clutch comprises a stud and arm.

15. A centrifugal fan as described in claim 14 wherein at least part of said clutch is housed within said damper support.

16. A centrifugal fan as described in claim 14 further comprising a fan housing.

17. A centrifugal fan as described in claim 14 wherein said axially translatable flowpath closure damper, when in said closed configuration, seals against said stationary fan inlet componentry.

18. A centrifugal fan as described in claim 14 wherein said stationary fan inlet componentry comprises an inlet cone having an annular, fan blade proximal surface portion that said damper seals against.

19. A centrifugal fan as described in claim 14 wherein said stationary fan inlet componentry directs fluid from upstream of said centrifugal fan into said centrifugal fan along a flowpath.

20. A centrifugal fan as described in claim 14 wherein said applied torque is applied by a motor.

21. A centrifugal fan as described in claim 14 wherein said rotatable componentry comprises a component selected from the group consisting of: fan back plate, componentry substantially against said fan back plate, central shaft, fan blades, and annular supports for fan blades.

22. A centrifugal fan as described in claim 14 wherein said rotatable componentry comprises a central shaft.

23. A centrifugal fan as described in claim 22 wherein said axially translatable flowpath closure damper comprises a central hole through which said central shaft passes.

24. A centrifugal fan as described in claim 22 wherein said axially translatable flowpath closure damper axially translates along said central shaft during reconfiguration from said open configuration to said closed configuration.

25. A centrifugal fan as described in claim 14 wherein said clutch automatically engages said axially translatable flowpath closure damper to said rotatable componentry.

26. A centrifugal fan as described in claim 14 wherein said clutch disengages said axially translatable flowpath closure damper from said rotatable componentry so that when said axially translatable flowpath closure damper is in said closed configuration, said axially translatable flowpath closure damper is disengaged from said rotatable componentry.

27. A centrifugal fan as described in claim 26 wherein said clutch automatically disengages said axially translatable flowpath closure damper from said rotatable componentry.

28. A centrifugal fan as described in claim 14 wherein said rotatable componentry comprises a fan back plate, and wherein said clutch engages said axially translatable flowpath closure damper to said fan back plate.

29. A centrifugal fan as described in claim 28 wherein said rotatable componentry comprises rotatable componentry that is substantially against a fan back plate, and wherein said clutch engages said axially translatable flowpath closure damper to said rotatable componentry that is substantially against said fan back plate.

30. A centrifugal fan as described in claim 14 wherein said clutch engages said axially translatable flowpath closure damper to said rotatable componentry at any of a limited number of angular locations during each engagement.

31. A centrifugal fan as described in claim 14 wherein said clutch engages said axially translatable flowpath closure damper to said rotatable componentry at the same angular location during each engagement.

32. A centrifugal fan as described in claim 14 wherein said centrifugal fan is a fan of a fan array.

* * * * *